US005362180A

United States Patent [19]

Canning et al.

[11] Patent Number: 5,362,180

[45] Date of Patent: Nov. 8, 1994

[54] FLOATATION BOOM WITH COLLAPSIBLE FLOATATION CASING

[75] Inventors: Daniel Canning; Serge Fraser, both of Montréal, Canada

[73] Assignee: 2910683 Canada Inc., Montreal, Canada

[21] Appl. No.: 82,557

[22] Filed: Jun. 28, 1993

[51] Int. Cl.[5] ..... E02B 15/04

[52] U.S. Cl. ..... 405/66; 405/63; 405/72

[58] Field of Search ..... 405/63, 66–70, 405/72

[56] References Cited

U.S. PATENT DOCUMENTS

| | | | |
|---|---|---|---|
| 3,798,911 | 3/1974 | Oberg | 405/70 X |
| 3,811,285 | 5/1974 | Ballu | 405/70 X |
| 4,068,478 | 1/1978 | Meyers et al. | 405/66 |
| 4,124,981 | 11/1978 | Preus | 405/66 |
| 4,295,755 | 10/1981 | Meyers | 405/66 |
| 4,652,173 | 3/1987 | Kallestad | 405/72 X |
| 4,752,393 | 6/1988 | Meyers | 210/242.3 |

*Primary Examiner*—Randolph A. Reese
*Assistant Examiner*—John A. Ricci

[57] ABSTRACT

A containment boom having the shape of an elongated floatable flexible wall member which is capable of being wound on a spool and deployed therefrom as described. The floatable flexible wall member has a vented flotation tubular membrane. A flexible sheet-like skirt member is secured along the tubular membrane along a longitudinal axis thereof. A ballast is secured to a lower elongated edge of the skirt member. The flotation tubular membrane is provided with a plurality of collapsible individual spiral coils disposed internally of the tubular membrane. The membrane support coils are secured to a plurality of bases which are interconnected to one another by a flexible connecting joint or the tubular membrane. A pull cable is secured along a top part of the tubular membrane.

22 Claims, 6 Drawing Sheets 16
17
11
20
51
10
12
24
19
51
15
14
15
13
15

10
26
16
16
17
18
42
44
46
20
11
25
13
15
12

Fig. 3
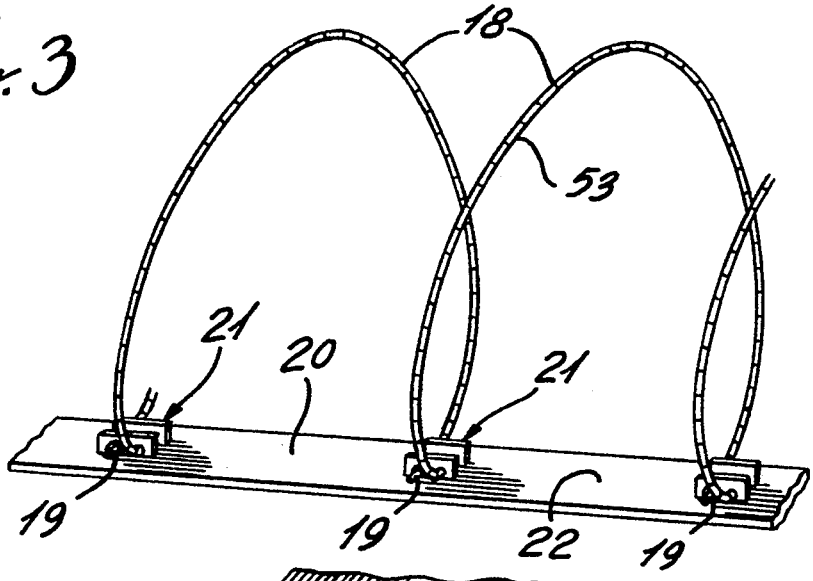
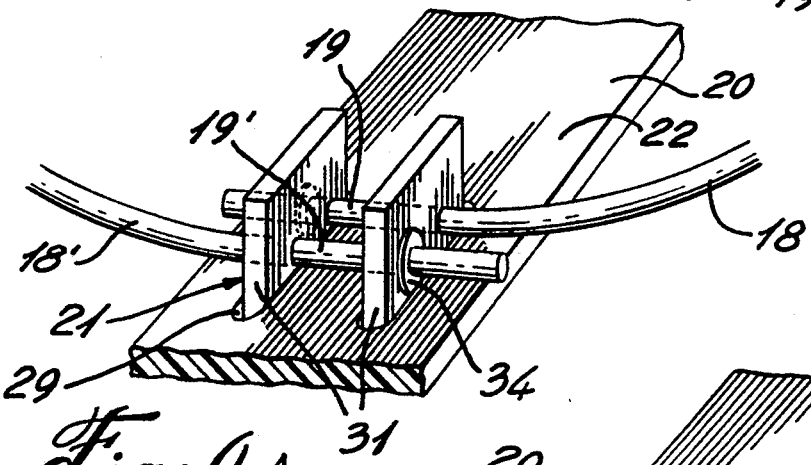
Fig. 4A
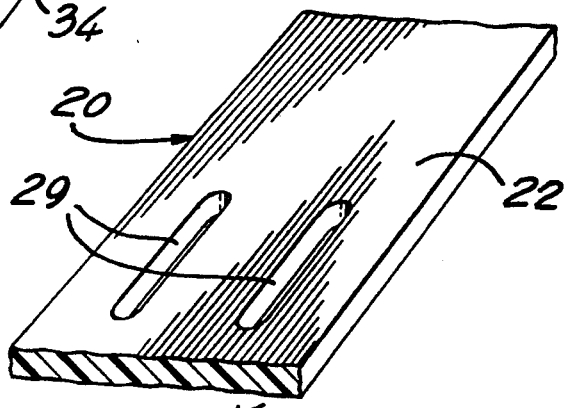
Fig. 4B
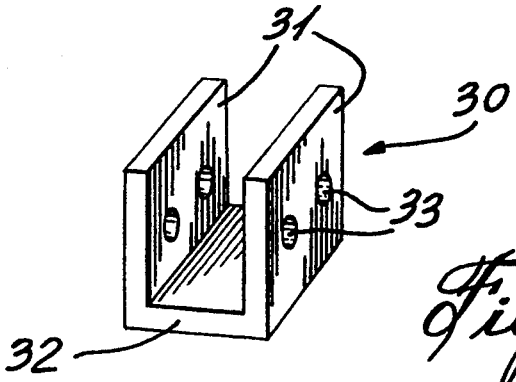
Fig. 4

FLOATATION BOOM WITH COLLAPSIBLE FLOATATION CASING

TECHNICAL FIELD

The present invention relates to a containment boom having a vented tubular membrane provided with an internal support mechanism having single spiral coils which are hingedly secured to a support base, and which can collapse in opposed directions along the longitudinal axis of the casing when wound on a take-up reel.

BACKGROUND ART

The containment boom of the present invention is of the type, as exemplified by U.S. Pat. Nos. 4,295,755 and 4,752,393, which represents the prior art. In those patents there is disclosed a containment boom wherein an elongated flotation casing is held expanded in a condition of use by an elongated spiral coil extending substantially throughout the length of the boom. When the containment boom is wound on a drum the coil collapses in a predetermined direction, and when the boom is deployed from the spool the coil springs back to its spiral coiled condition. The flotation casing may also be segmented internally by partition walls which are secured to the casing and some of the spirals of the coil. Such containment booms have certain disadvantages in that they are difficult to repair when the coil spring becomes damaged. Also, they are also difficult to manufacture due to their long unitary coil construction. Furthermore, some of the casings use thick flotation blocks internally thereof to provide buoyancy. These booms also occupy irregular thick spaces on a reel when wound thereon. It is therefore not possible to store very long boom lengths, or else very large reels are necessary for its storage. A still further disadvantage of such prior art containment boom is that the boom is pulled onto the spool or reel by the ballast which is usually a chain secured to the bottom of a skirt. Accordingly, there is not a uniform pulling force across the boom when wound on the reel, and this causes irregularities in the boom stored on the reel which can lead to damage.

SUMMARY OF INVENTION

It is a feature of the present invention to provide a containment boom which substantially overcomes the above-mentioned disadvantages of the prior art.

Another feature of the present invention is to provide a containment boom wherein the flotation casing is a vented flotation tubular membrane having a plurality of single spiral coils hingedly secured at their free ends to a support mechanism which facilitates assembly and replacement of individual spiral coils.

Another feature of the present invention is to provide a containment boom wherein the coils may collapse in opposed directions so that the boom can be wound from either of its opposed ends onto a take-up reel.

Another feature of the present invention is to provide a containment boom with rigid pulling means along opposed longitudinal edges thereof to permit a uniform pulling force to be applied across the boom when wound on a take-up reel.

Another feature of the present invention is to provide a containment boom which automatically deploys itself from a reel and wherein the boom may be formed in sections to facilitate repair thereof.

Another feature of the present invention is to provide a containment boom which occupies a minimum thickness of space when wound on a reel so that longer boom lengths can be stored on a reel.

Another feature of the present invention is to provide a containment boom having an improved venting means and flotation means.

Another feature of the present invention is to provide a containment boom wherein the individual spiral coils are provided with friction-reducing bearing means to reduce friction between the coils and the inner surface of the tubular flotation membrane.

According to the above features, from a broad aspect, the present invention provides a containment boom comprising an elongated floatable flexible wall member capable of being wound on a reel and deployed therefrom. The floatable flexible wall member has a vented flotation tubular membrane A flexible sheet-like skirt member is secured along the tubular membrane on a longitudinal axis thereof. Ballast means is secured to a lower elongated edge of the skirt member. The flotation tubular membrane has a plurality of individual collapsible membrane support means disposed internally of the tubular membrane. The membrane support means are connected to one or more supports which are also connected to the tubular membrane. Pulling means is secured along a top part of the tubular membrane.

BRIEF DESCRIPTION OF DRAWINGS

A preferred embodiment of the present invention will now be described with reference to examples thereof as illustrated in the accompanying drawings in which:

FIG. 3 is a perspective view showing the interconnection of the individual spiral coils on its support base member;

FIG. 4A is an enlarged perspective view showing the pivotal connection of the coils;

FIG. 4B is a perspective view showing the construction of a portion of the support base for receiving an attachment bracket;

FIG. 4C is a perspective view of the attachment bracket;

DESCRIPTION OF PREFERRED EMBODIMENTS

Figure 1:
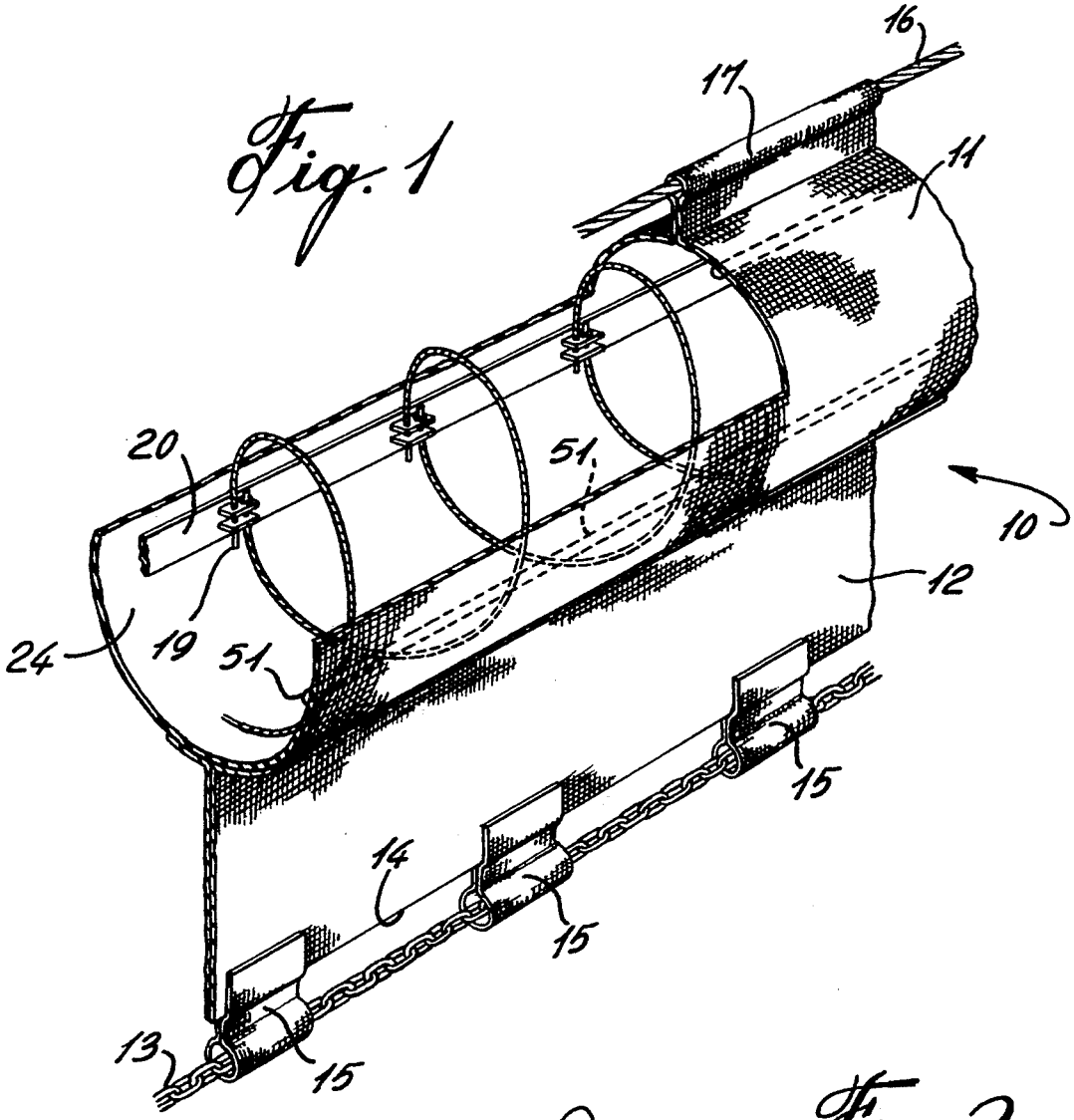
FIG. 1 is a perspective view of a containment boom constructed in accordance with the present invention.
Figure 2:
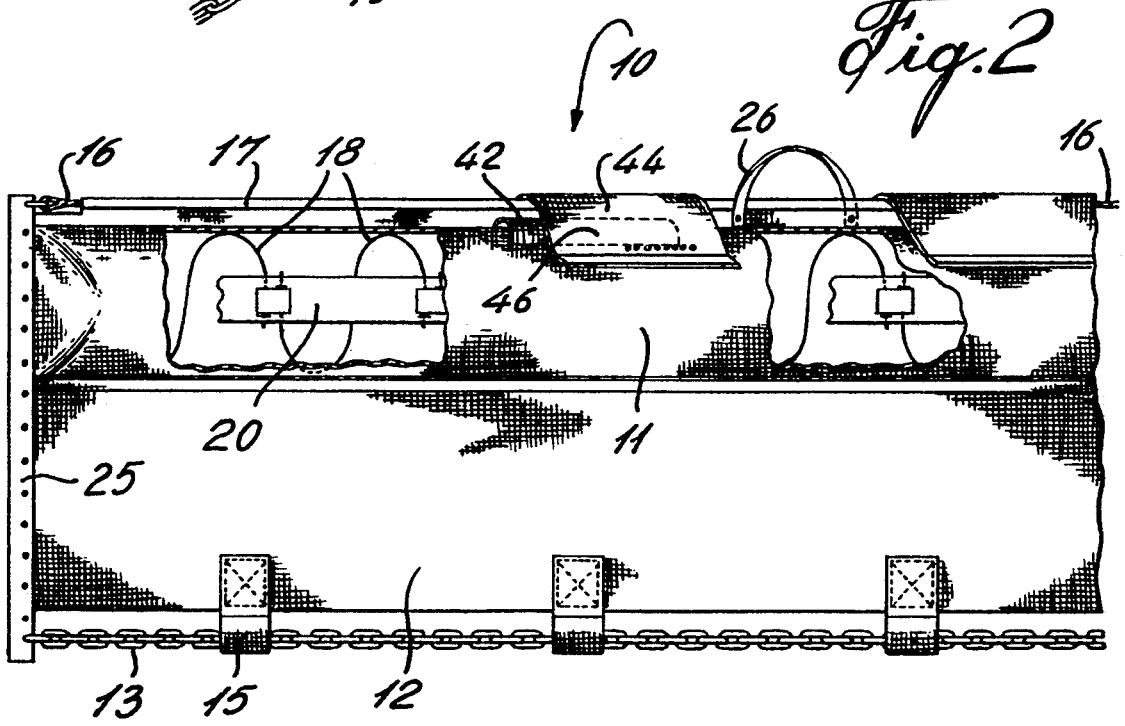
FIG. 2 is a fragmented side view illustrating the construction of a containment boom of the present invention.

Referring now to the drawings, and more particularly to FIGS. 1 and 2, there is shown generally at 10 the containment boom of the present invention. The boom is formed as an elongated floatable flexible wall member which is capable of being collapsed and wound on a reel 100 (see FIGS. 10 and 11) and deployed therefrom. The floatable flexible wall member comprises a vented flotation tubular membrane 11 having a flexible sheet-like skirt member 12 secured along a longitudinal axis thereof. Ballast means in the form of a metal chain 13 is retained along a lower elongated edge 14 of the skirt by support sleeves 15. A pull cable 16 is connected to the flotation tubular membrane 11 along a top portion thereof and nested within an elongated sleeve 17 formed of the same flexible material as the tubular membrane 11. This material is a water impermeable material, such as a suitable plastics material. Preferably, but not exclusive, the material may also be an ultraviolet-resistant material, such as a 22-ounce PVC or polyurethane.

Figure 9:
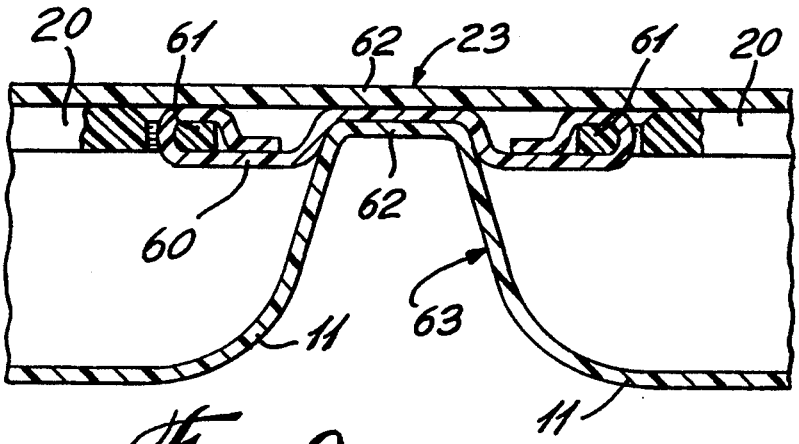
FIG. 9 is a fragmented section view illustrating the flexible connecting joint which interconnects the membrane support means.

The flotation tubular membrane 11 is herein shown as being of circular cross-section, but it is to be understood that its cross-section may also have other forms, such as being rectangular, hexagonal, or even triangular. The flotation tubular membrane is maintained in its expanded condition, as shown in FIG. 1, by a plurality of collapsible membrane support means which is comprised of one or more, herein a plurality, of individual spiral coils 18 which are hingedly secured at opposed free ends 19 thereof (see FIG. 3) to an elongated coil support base member 20. A plurality of attachment brackets 21 are equidistantly secured to the base member 20 and extends above its top surface 22. It is pointed out that the base member 20 is of a predetermined length, and that a plurality of these base members are interconnected together internally of the flotation tubular membrane 11 by flexible connecting joints 23, as shown in FIG. 9. The base 20 is also constructed of a solid flexible material, such as rectangular plastic rods which is capable of being bent about the reel 100 when wound thereabout. It is also conceivable that the bases be of very short lengths for securing single ones of the spiral coils with all of the bases interconnected by a flexible joint.

As shown in FIGS. 1 and 2, the bases 20 are secured to the inner surface 24 of the flotation tubular membrane 11 and extend substantially parallel to the longitudinal axis of the tubular membrane and disposed to a side thereof along a plane which is at 90° from the plane of the skirt member. The ends of the booms are also provided with a rigid transverse seam 25 to which is secured the pull cable 16 and the ballast metal chain 13. Handles 26 may also be secured at spaced intervals along the sleeve 17 in the top region of the tubular membrane 11.

Referring now more specifically to FIGS. 4A to 4C, there is shown the construction of the attachment bracket 21. As herein shown, the base member 20 is an elongated rectangular, plate-like member, having a pair of aligned slots 29 disposed transversely thereto at regular intervals throughout the length of the base. The attachment bracket 21 is formed by a U-shaped clamp 30 having opposed side walls 31 and an intermediate base wall 32. The side walls 31 are each provided with a pair of retention holes 33, with the retention holes in each of the side walls being aligned with the holes in the other side wall. The U-shaped clamp 30 is received loosely within the slots 29 and extend therethrough, as shown in FIG. 4A. The holes 33 lie just above the top surface 22 of the base member.

Figure 8:
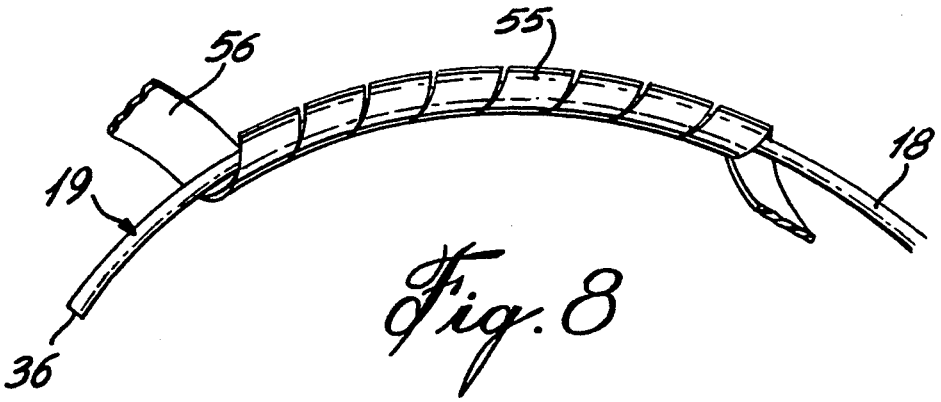
FIG. 8 is a fragmented perspective view showing one form of friction-reducing bearing means secured about the individual spiral coils.

As shown in FIG. 4A, the free ends 19 and 19' of opposed coils 18 and 18' are disposed through a pair of retention holes formed by aligned holes in opposed side walls 31 to bridge the side walls just above the top surface 22 of the base 20. The coils are held in position by friction lock washers 34 secured on each outer surface of the side walls 31 and engaged about the outer surface of the coils a predetermined distance from opposed terminal ends 36 thereof, as shown in FIG. 8. The washers 34 extend partly within the slot 29 to prevent axial displacement of the end portion of the coils.

Figure 4D:
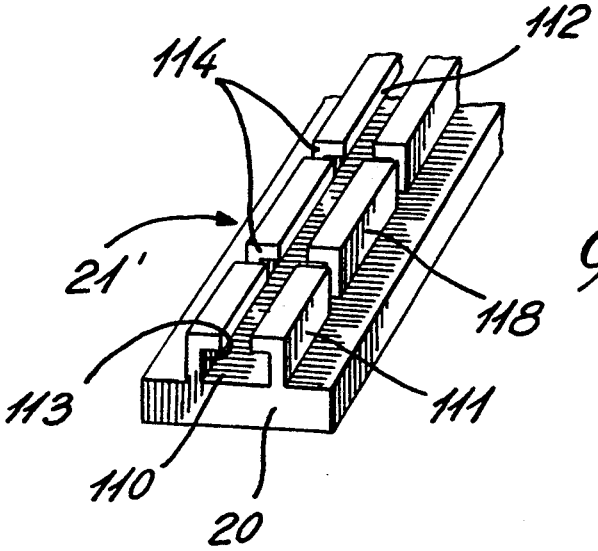
FIG. 4D is a perspective view showing another embodiment of a support base of another pivotal connection.
Figure 4E:
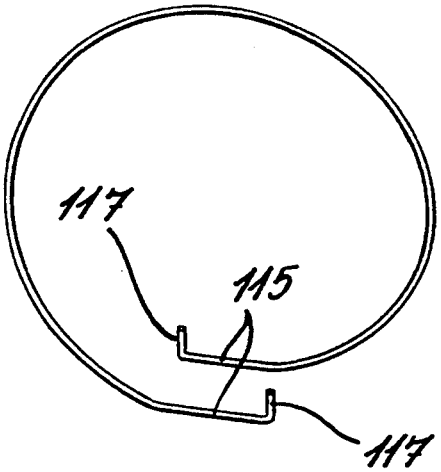
FIG. 4E is a perspective view showing the coils provided with end straining fingers.
Figure 4F:
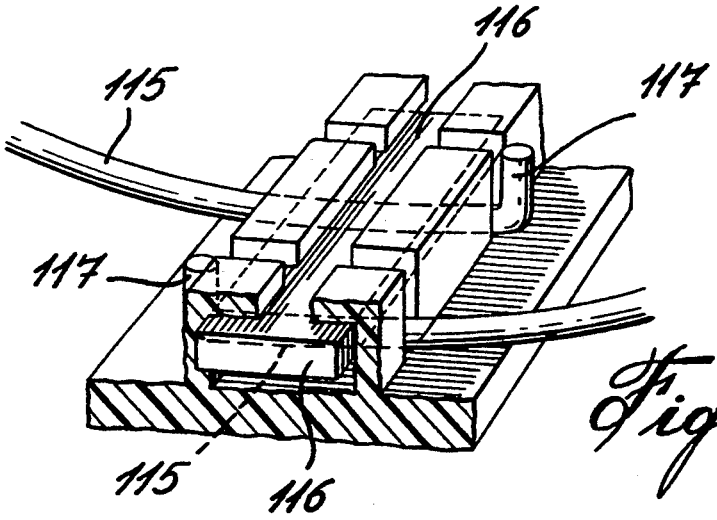
FIG. 4F shows the coils retained on the support base by a locking bar assembled with the base.

Referring now to FIGS. 4D to 4F, there is shown another embodiment of the construction of the attachment bracket 21'. As herein shown, the attachment bracket is formed integral with the base member 20 which is essentially an inverted T-shape plastic extrusion having the junction base portion 111 thereof provided with an elongated central slot 112 leading to an enlarged undercut cavity 113. The junction base portion 111 is then cross-cut at regular intervals to define coil receiving slots 114 in which end portions 115 of opposed coils are received and retained by means of an elongated rectangular retention bar 116, as shown in FIG. 4F.

As shown in FIG. 4E, the terminal ends of each coil 18' are bent at a 90° angle to form a retention finger 117, and these are aligned with the outside walls 118 of the junction base portion 111. When the elongated rectangular retention bar 116 is slid within the undercut end cavity over the coil end portions 115 they bridge the coil receiving slots 114 and lock the coils in place while permitting these coils to be collapsed against the base 20 as previously described.

Figures 5, 6:
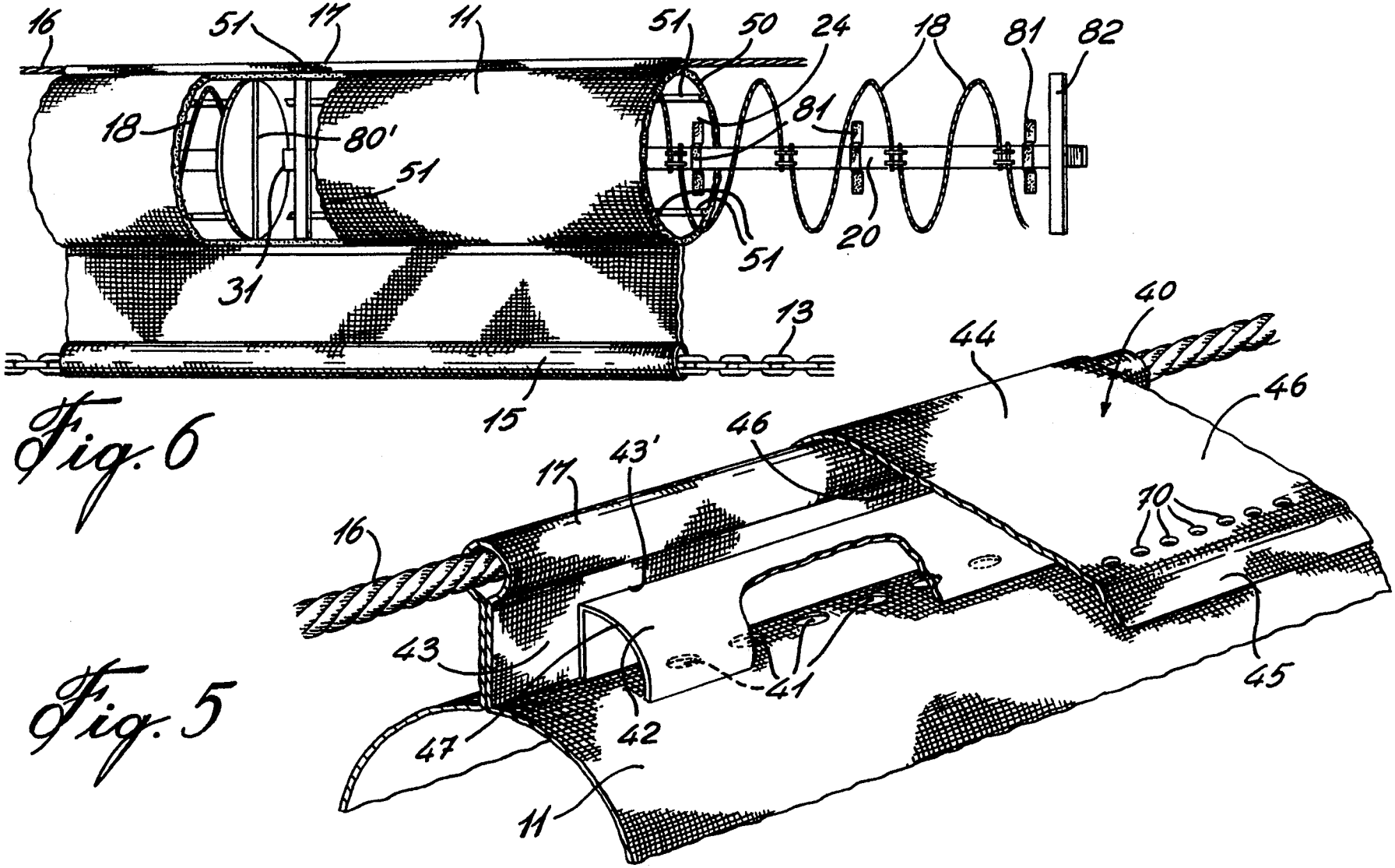
FIG. 5 is a fragmented perspective view showing the construction of the venting assembly associated with the flotation tubular membrane for the venting thereof.
FIG. 6 is a fragmented perspective view showing further modifications of the tubular membrane.

Referring now to FIG. 5, there is shown the manner in which the flotation tubular membrane 11 is vented. As herein shown, the vent means 40 is comprised of a plurality of vent holes 41 formed in a top portion of the tubular membrane 11 and disposed on opposite sides of the longitudinal wall 43 depending from the sleeve 17. A window 43' is cut in the wall 43 above its seam with the outer surface 46 of the membrane. An inverted dome-shaped cover 42 is disposed in the window and aligned with the wall 43, as shown. In fact, the cover 42 may be secured to the wall 43 by glue or other attachment means, which spans over the vent holes 41. A splash-guard flap 44 spans over the sleeve 17 and is secured along its opposed longitudinal edges 45 to the outer surface 46 of the tubular membrane 11 by suitable means, such as glue or a heat seal. The splash-guard flap 44 as well as the cover 42 shield the vent holes 41 from water splashing against the boom flotation membrane 11 and also permit free passage of air to escape and enter from the opposed ends 46 of the splash-guard flap and the opposed ends 47 of the dome-shaped cover 42. Accordingly, air can flow into the tubular membrane or out of the tubular membrane from these vent holes. The vent holes also permit water that may find its way into the membrane 11 to escape when the boom is wound on the reel 100. These vents are disposed spaced apart along the tubular membrane 11. Small drain holes 70 are disposed adjacent the edges 45 and provide water to seep out from behind the flap. The holes are sufficiently small to prevent water from entering the flap when splashed thereagainst.

Referring now to FIG. 6, there is shown various modifications of the containment boom. As herein shown, the membrane 11 may be formed from a foam core sheet 50 to provide added buoyancy to the tubular membrane. The membrane 11 may also be provided with elongated friction bearing bands 51 disposed longitudinally of the boom along the inner surface 24 of the membrane to protect the membrane from the spiral coils 18 which move thereagainst. In order to further protect the membrane from the coils 18, each coil is provided with a plurality of short plastic sleeves 53, as shown in FIG. 3, or an elongated spirally wound plastic tube 55, as shown in FIG. 8. The tube 55 is formed spirally from a coiled flat plastic strap 56 and is of a predetermined length to expose the free end portions 19 of the coils 18, as shown in FIG. 8, for attachment to the brackets 21.

Figure 7:
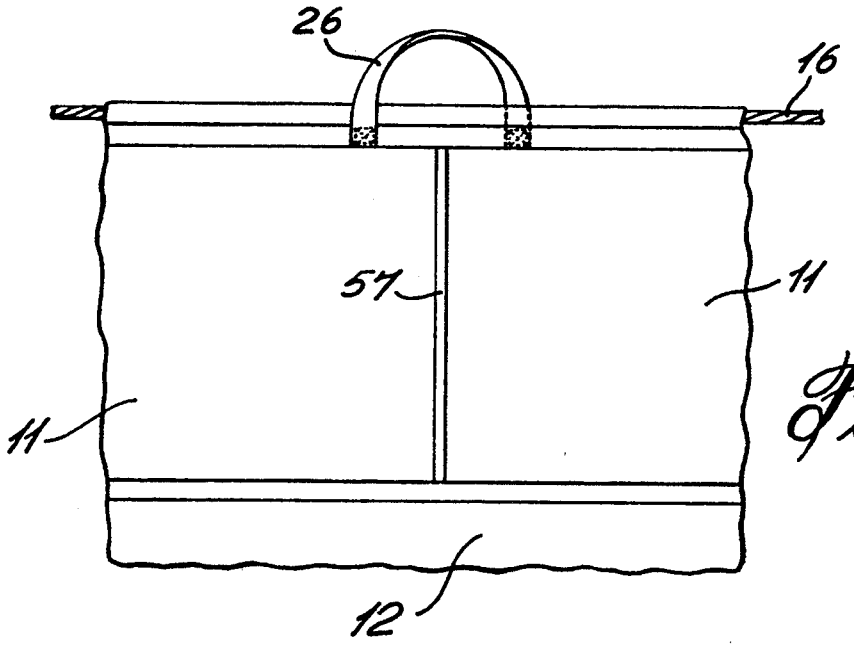
FIG. 7 is a fragmented perspective view illustrating a further modification of the flotation tubular membrane.

FIG. 7 illustrates a still further modification of the flotation tubular membrane 11 and, as herein shown, a transverse seam 57 may be formed across the tubular membrane at intervals between the membrane support means, that is to say, between the connecting bases 20 or some of the bases 20 depending on their lengths, and across the connecting joint 23, as shown in FIG. 9. This would create individual chambers and isolate these chambers from one another. Accordingly, if one of the chambers were to be punctured or filled with water, it would still be supported by the adjacent chambers and not affect the containment of the boom. Furthermore, if a spiral coil is required to be changed, it is only necessary to effect repair to the side walls of one of the chambers for access to the coil. Also, if leaks develop in the membrane, it would not affect the efficiency of the boom. The seam 57 also prevents water from flowing throughout the tubular membrane.

As shown in FIG. 9, the flexible connecting joint 23 may be constituted by a connecting strap 60 formed of flexible material, such as plastics, nylon, etc., and connected to the spaced apart ends 61 of opposed base members 20. Opposed wall portions 62 of the tubular membrane 11 are then heat fused to the connecting strap 60. This causes a wall region, as shown generally at 63, to collapse inwardly in the area of the connection to the strap 63. However, because this connection is in the vertical plane of the tubular membrane, it still provides a transverse wall obstruction across the boom to prevent floating contaminants from floating out of the containment boom when position on a body of water. Air would communicate within the tubular membrane from opposed sides of the connecting joint 23, but as discussed hereinabove with reference to FIG. 7, if the seam 57 is made entirely across the tubular membrane, then individual chambers would be formed along the length of the boom.

Referring again to FIG. 6, there is shown still further modifications wherein, instead of sectioning the tubular membrane as shown in FIGS. 7 and 9, a flexible separating disc or wall 80 is fused across the inner face of the tubular membrane at spaced intervals between the ends 31 of the base member 20. The circular wall 80 is folded in half along its diameter 80' to form a pocket which is fused along a circumferential edge to the inner surface of the membrane 11. Also, the base member 20 may be secured to the inner face by straps 81 fused thereto. Still further, in order to maintain the tubular membrane upright, when in use, a T-bar 82 may be secured at the ends or elsewhere along the base member 20 and supported vertically. This would ensure that the vent holes 41 are maintained in the uppermost part of the tubular membrane.

Various other modifications of the preferred embodiment described herein are intended to be covered by the present invention, provided they fall within the scope of the appended claims. It is pointed out that the base members 20 may be of various lengths and cross-sections and may be constructed of various materials. These base members provide additional rigidity to the tubular membrane and must be able to bend in order to wind the containment boom on a large reel having a diameter of about 2 feet or more. Also, the spacing between the attachment brackets 21 is such as to permit the coils to automatically deploy themselves during the deployment of the containment boom from the reel 100, and to assume their upright position by the spring action of the coils due to the manner by which they are secured to the bases 20 and the spacing of the brackets 21. These coils are preferably constructed of stainless steel wire, but other wire-like materials possessing the desired functional characteristics of the coil may be utilized. It is also conceived that other flotation material can be positioned inside the flotation membrane without impairing the functioning of the individual coils. The materials utilized for the construction of the tubular membrane and skirt must be resistant to contaminants that are usually harnessed by such booms. It is also to be understood that when the flotation membrane 11 is divided into individual chambers, either by the disc 50 or by the transverse weld seam 57, each of these chambers is provided with a vent means 40, such as shown at FIG. 5. Also the vent holes must be of sufficient size to provide easy passage of air to and from these chambers when the boom is being wound or deployed from the reel.

Because the containment boom 10 of the present invention is provided with a steel cable 16 at the top part thereof and a steel chain 13 in the ballast region, it permits a traction or pulling force to be applied across the boom when pulled on a body of water by a boat, and prevents damage to the boom if the pulling force was only from one side of the boom, as is often the case with prior art booms of this type. As previously described, because the boom is made in sections, it is easy to repair the boom and effect regular maintenance, such as cleaning it from oil deposits. These chambers may have a length of up to 10 feet, or more.

Figure 11:
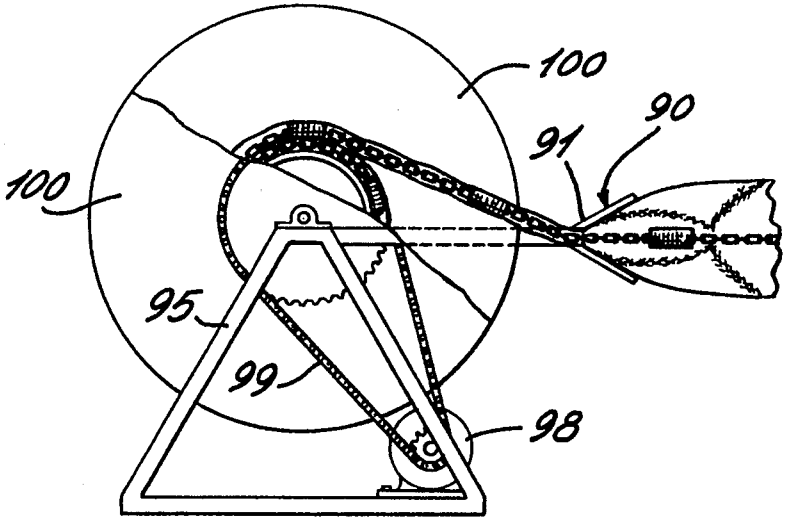
FIG. 11 is a side view showing the construction of the reel with its flotation casing collapsing mechanism.
Figure 10:
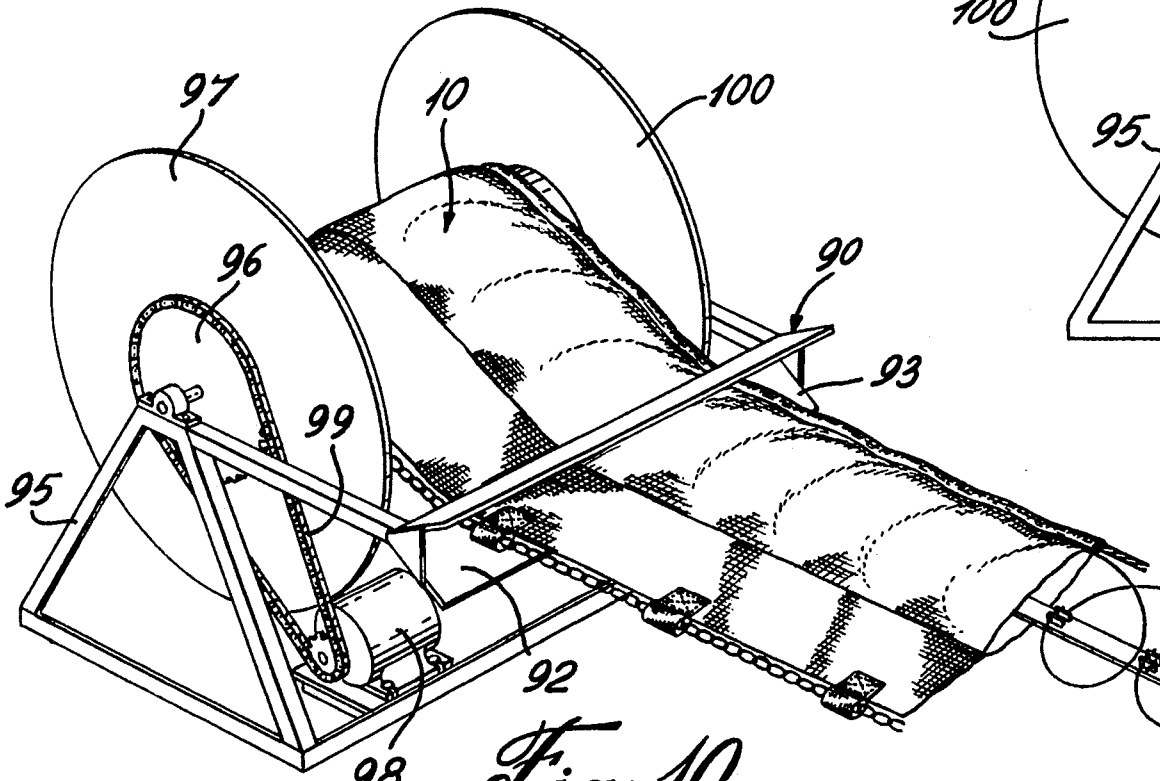
FIG. 10 is a perspective view showing the containment boom of the present invention being wound or deployed from a storage reel.

As shown in FIGS. 10 and 11, the reel 100 is supported on a frame 95 and provided with a drive gear 96 adjacent a spool end wall 97. The gear 96 is driven by a motor 98 through a link chain 99.

The frame 95 further supports a boom collapsing mechanism 90 which is comprised of an elongated truncated trough 91 having a plurality of elongated guide rolls 92 secured adjacent an inner surface 93 of opposed walls thereof to collapse the coils 18 inside the elongated tubular membrane 11 as it is wound passed through the trough when about the reel 100. The flotation casing collapsing mechanism 90 is held rigid in position, as shown in FIG. 11.

Figure 12:
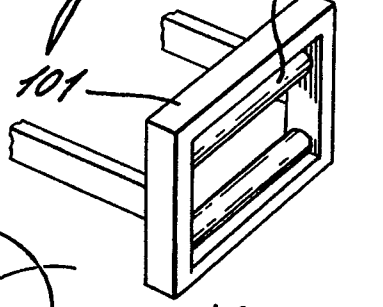
FIG. 12 is a perspective view of an alternate embodiment of the casing collapsing mechanism.

As shown in FIG. 12, the casing collapsing mechanism 90 can be constituted simply by a rectangular frame 101 having a pair of spaced apart guide rolls 102 disposed longitudinally thereof for collapsing the tubular membranes and the coil springs therein.

It is within the ambit of the present invention to cover any obvious modifications of the examples of the preferred embodiment described herein, provided such modifications fall within the scope of the appended claims.

We claim:

1. A containment boom comprising an elongated floatable flexible wall member capable of being wound on a reel and deployed therefrom, said floatable flexible wall member having a vented floatation tubular membrane, a flexible sheet-like skirt member secured along said tubular membrane on a longitudinal axis thereof, ballast means secured to a lower elongated edge of said skirt member, said flotation tubular membrane having a plurality of single spiral coils hingedly secured at opposed free ends to a coil support means, said plurality of single spiral coils being collapsible in the direction of said longitudinal axis and in either opposed directions thereof, said support means being connected to said tubular membrane, and pulling means secured to a top part of said flexible wall member.

2. A containment boom as claimed in claim 1 wherein said support means comprises at least two of said individual spiral coils.

3. A containment boom as claimed in claim 2 wherein said support means is an elongated coil support base member disposed adjacent an inner surface of said tubular membrane and extending along said longitudinal axis, said coil support base having attachment brackets for receiving one of said opposed free ends of adjacent individual spiral coils.

4. A containment boom as claimed in claim 5 wherein said support base is constructed of flexible material, said attachment brackets each having spaced apart coil retention means for receiving an end portion of said one of said free ends of opposed coils therein.

5. A containment boom as claimed in claim 4 wherein each said bracket is removably secured to said coil support base, said bracket comprising a U-shaped clamp having opposed flat side walls and a bridge wall, said coil support base being an elongated flexible rectangular member having two or more pairs of aligned slots disposed longitudinally thereof, said bracket side walls being received in one of said pairs of aligned slots and extending above a top wall of said support base, said opposed flat side walls each having two spaced apart coil retention holes, said holes in each said side walls being aligned with one another, said end portion of said free ends of said opposed coils extending across said pair of side walls through a pair of said retention holes and bridging said side walls above said top wall of said support base, and connecting means to secure said free ends to said side walls.

6. A containment boom as claimed in claim 5 wherein said connecting means is a friction washer engageable about opposed terminal end portions of each said coil.

7. A containment boom as claimed in claim 3 wherein there are two or more of said support base members, each member being interconnected by a connecting strap of flexible material connected to spaced apart end portions of adjacent coil support base members, said connecting strap being secured to said inner surface of said tubular membrane.

8. A containment boom as claimed in claim 7 wherein said connecting strap is secured along a straight axis of said tubular membrane with said axis disposed in a plane lying at right angle to the plane of said skirt.

9. A containment boom as claimed in claim 8 wherein said connecting strap and said tubular membrane are constructed of material capable of being fused together, said strap being connected to said inner surface of said tubular membrane by a heat fusing weld.

10. A containment boom as claimed in claim 3 wherein there are two or more of said support base members, each member being connected against an inner surface of said tubular membrane.

11. A containment boom as claimed in claim 10 wherein transverse separation discs are secured between opposed ends of said support base members.

12. A containment boom as claimed in claim 1 wherein said tubular membrane is formed by individual inner chambers sealed from one another.

13. A containment boom as claimed in claim 1 wherein each said coils are constructed of material selected from the group comprising plastics materials, or fiberglass or metals capable of exhibiting a spring force.

14. A containment boom as claimed in claim 1 wherein there is further provided friction reducing bearing means secured about each said one or more individual spiral coil to reduce friction when each said coil is moved in support engagement with an inner surface of said tubular membrane.

15. A containment boom as claimed in claim 14 wherein said bearing means is comprised of a plurality of tubular bearing sleeves disposed about said coil and spaced from opposed free end portions of said coil.

16. A containment boom as claimed in claim 15 wherein said bearing means is comprised of a spiral plastic tube formed from a spirally coiled flat plastic strap and disposed about said coil and spaced from opposed free end portions of said coil, said plastic tube being axially rotatable about said individual spiral coil.

17. A containment boom as claimed in claim 1 wherein said ballast means is a metal chain connected to said lower elongated edge of said skirt member.

18. A containment boom as claimed in claim 1 wherein a vent means are disposed at spaced intervals along said tubular membrane and each comprised of a plurality of holes formed in a top portion of said tubular membrane and disposed substantially opposite said longitudinal axis where said skirt is connected, an inverted dome-shaped rigid cover member held over said one or more holes, and a splash-guard flap disposed over said cover, said holes permitting air passage to and from an inner area of said tubular membrane, said air passage being effectuated from opposed ends of said cover and splash guard flap.

19. A containment boom as claimed in claim 18 wherein said cable is secured at opposed ends thereof to a transverse end seam at opposed ends of said floatable flexible wall member and retained captive along said top portion of said tubular membrane in an elongated sleeve.

20. A containment boom as claimed in claim 1 wherein there is further provided a plurality of spaced apart handles secured along said top portion of said tubular membrane.

21. A containment boom as claimed in claim 1 wherein said tubular membrane is formed from a thin foam core sheet.

22. A containment boom as claimed in claim 1 wherein said tubular membrane is provided with elongated friction bearing bands disposed longitudinally on an inner surface thereof.

* * * * *